United States Patent [19]

Alneng et al.

[11] Patent Number: 4,736,856

[45] Date of Patent: Apr. 12, 1988

[54] TRAY STAND

[75] Inventors: Carl-Goran Alneng, Danderyd; Sven Aven, Bromma; Ingmar Carlsson, Sundbyberg, all of Sweden

[73] Assignees: Sintek AB; Apoteksbolaget AB, both of Stockholm, Sweden

[21] Appl. No.: 890,529

[22] Filed: Jul. 30, 1986

[30] Foreign Application Priority Data

Aug. 1, 1985 [SE] Sweden ..... 85036713
Mar. 7, 1986 [SE] Sweden ..... 86010618

[51] Int. Cl.[4] ..... A47F 3/14

[52] U.S. Cl. ..... 211/131; 211/133; 211/163

[58] Field of Search ..... 211/131, 133, 129, 78, 211/205, 126, 163, 144; 108/103, 94

[56] References Cited

U.S. PATENT DOCUMENTS

| | | | |
|---|---|---|---|
| 353,419 | 11/1886 | Lamson | 211/131 X |
| 574,380 | 1/1897 | Bradley | 211/131 X |
| 727,107 | 5/1903 | Donaldson | 211/131 |
| 922,888 | 5/1909 | Grunwaldt | 211/131 |
| 2,553,507 | 5/1951 | Rosenberg | 211/131 |
| 3,198,338 | 8/1965 | McCormick | 211/131 X |
| 4,453,640 | 6/1984 | Cillario | 211/133 |

*Primary Examiner*—Ramon S. Britts
*Assistant Examiner*—Sarah Lechok Eley
*Attorney, Agent, or Firm*—Schwartz, Jeffery, Schwaab, Mack, Blumenthal & Evans

[57] ABSTRACT

A tray stand includes a vertical column (1, 12) and a plurality of circular trays (3, 14), rotatably carried by the column and situated one above the other. Each such tray includes a plurality of substantially circle sector-shaped sections (4, 22), which are carried by a common holder or hub (5, 16) rotatably mounted on the column, so that together they form a circular tray. The circle sector-shaped tray sections (4, 22) are arranged on arms (56, 18) radially projecting from the holder (5, 16) so that substantially the whole surface of each section in the tray (3, 14) is accessible without obstruction by the overlying tray (3, 14).

7 Claims, 6 Drawing Sheets

TRAY STAND

The present invention relates to a tray stand of the type sometimes known as a carrousel and comprises a central vertical column which is usually provided with some kind of foot at its lower end, and a plurality of rotatably mounted circular shelves arranged one above the other.

Tray stands of this kind may be used for storing goods in such as warehouses, self-service shops and other sales locations and have the advantage that they can accommodate a large amount of goods while utilizing a small floor space, the goods being easily and rapidly accessible, due to the individual rotatability of the different trays about the column of the tray stand, without a person needing to move round it. For example, an assistant sitting still, or several assistants sitting at different places round the stand can rapidly and easily get access to the different goods stored in the tray stand, while at the same time refilling with new goods can take place at another place along the circumference of the stand, without these different work operations needing to disturb each other to a noticeable degree.

In order that such a tray stand shall contain as large a quantity of goods as possible it is desirable that the distance between the different trays situated one above the other does not noticeably exceed the height of the goods stored on them. A decrease in a distance between trays situated one above the other causes deterioration in accessibility, however, both for taking out goods from the tray stand and above all for filling the trays with new goods.

The object of the present invention is therefore to provide an improved tray stand of the kind mentioned above, in which accessibility for removal of goods as well as filling new goods is substantially improved, although the spacing between shelves situated one above the other is small.

Another object is to provide a tray stand which is simply constructed and easy to erect, dismantle and transport.

These and other objects of the invention are achieved by its having been given the characterizing features disclosed in the following claims.

The invention will now be described in detail in connection with the drawings on which are shown preferred embodiments of tray stands executed in accordance with the invention.

Figure 1:
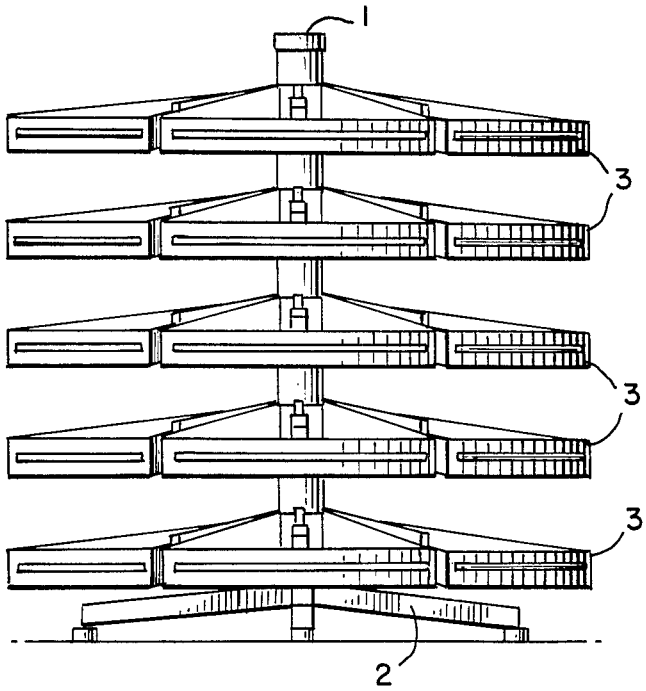
Figure 2:
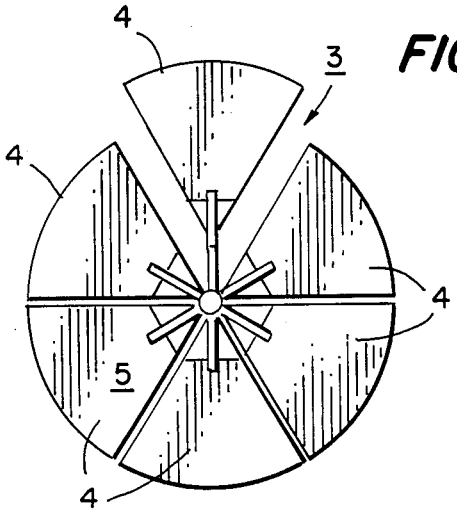
Figure 3:
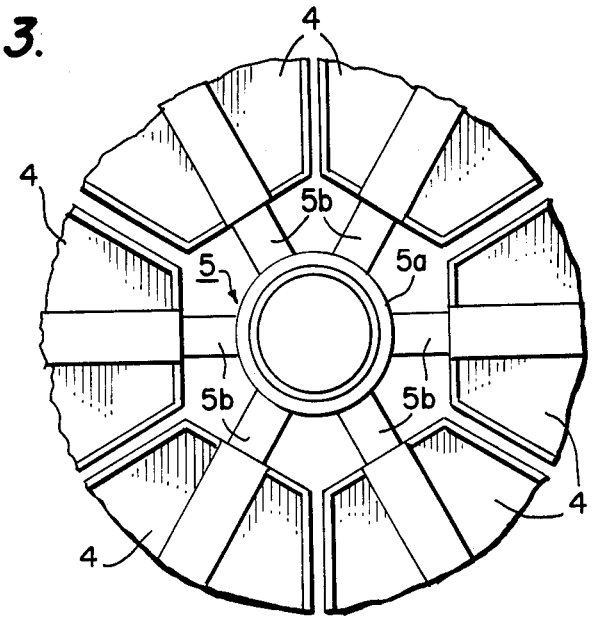
Figure 4:
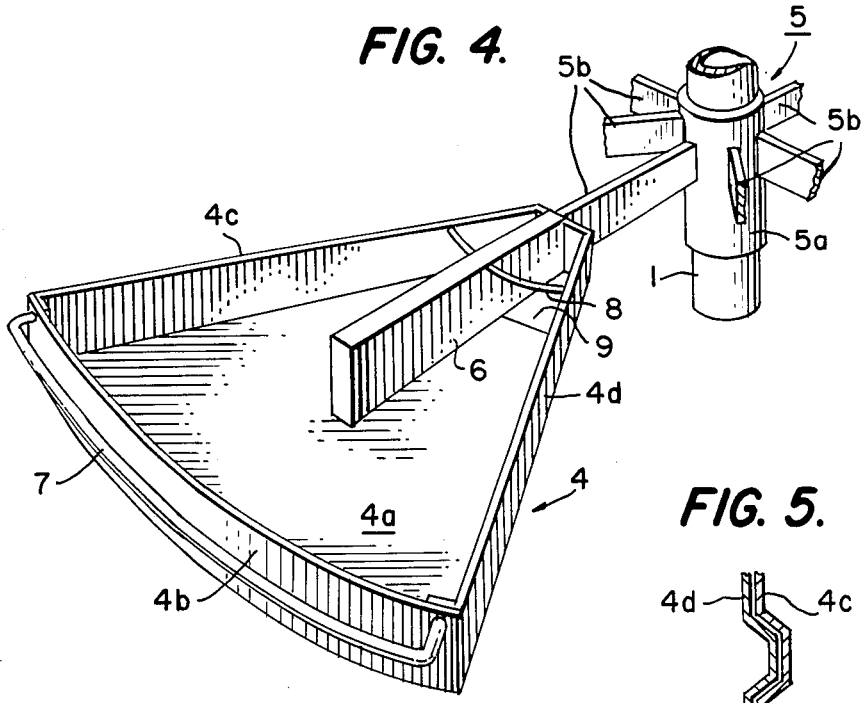
Figure 5:
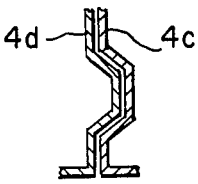
Figure 6:
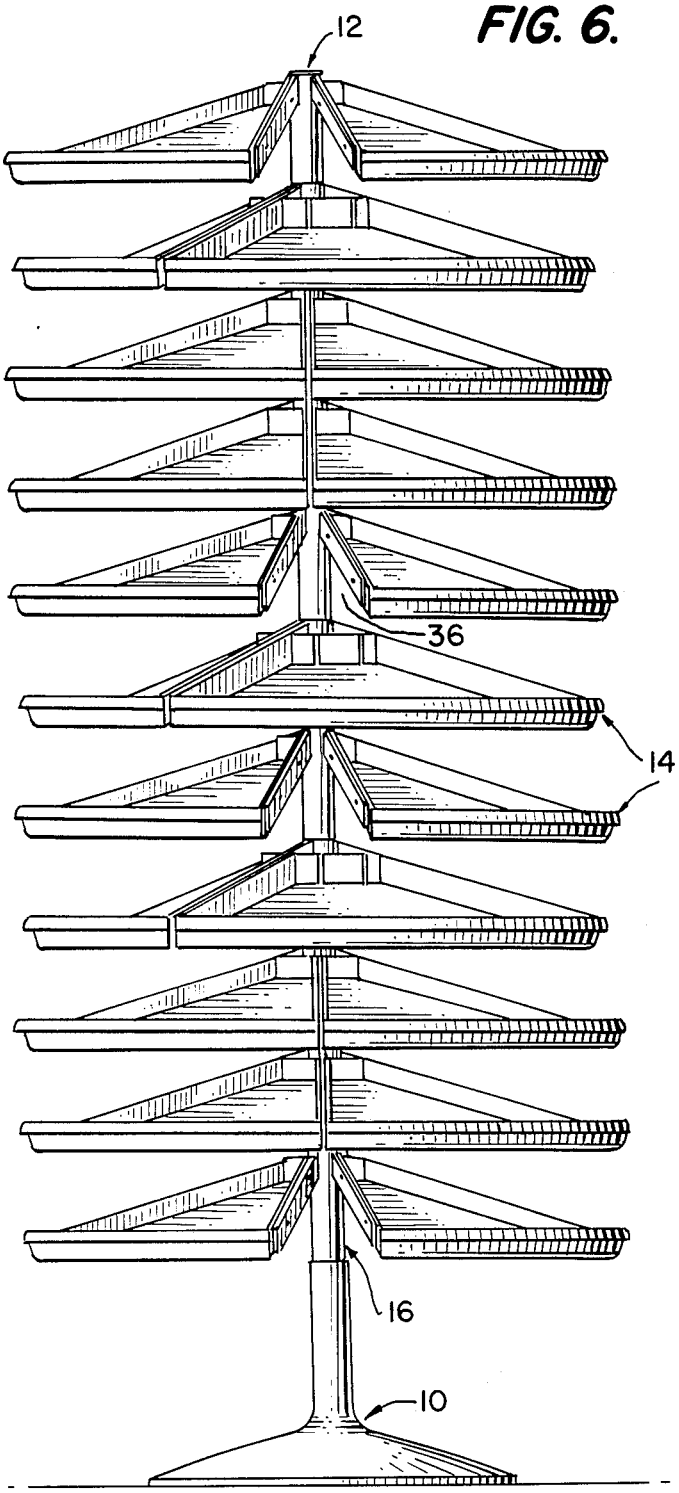
Figure 7:
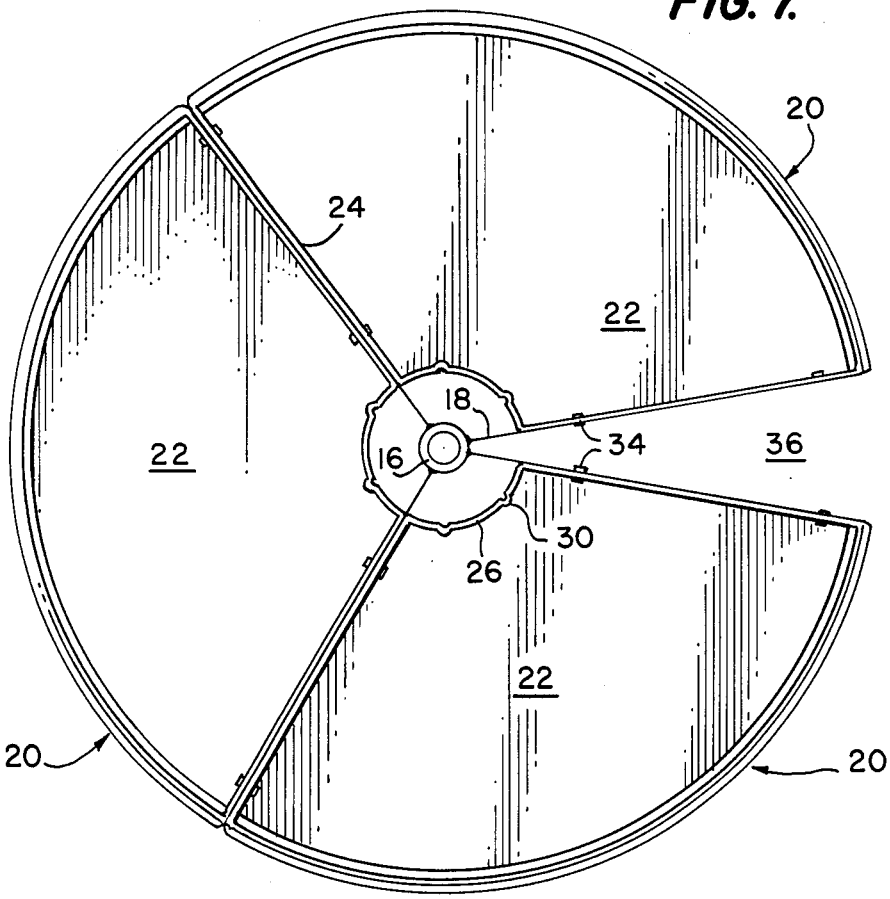
Figure 8:
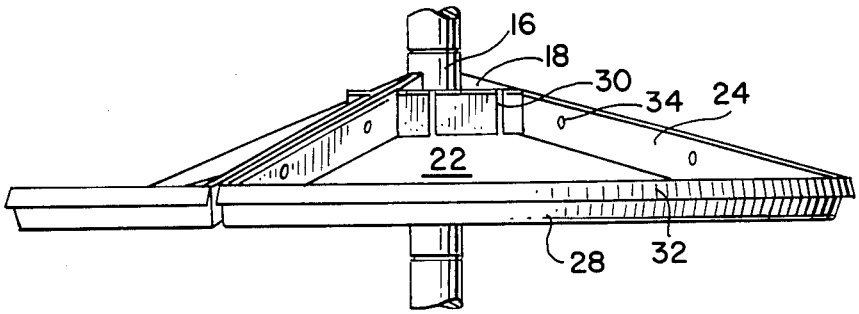
Figure 9:
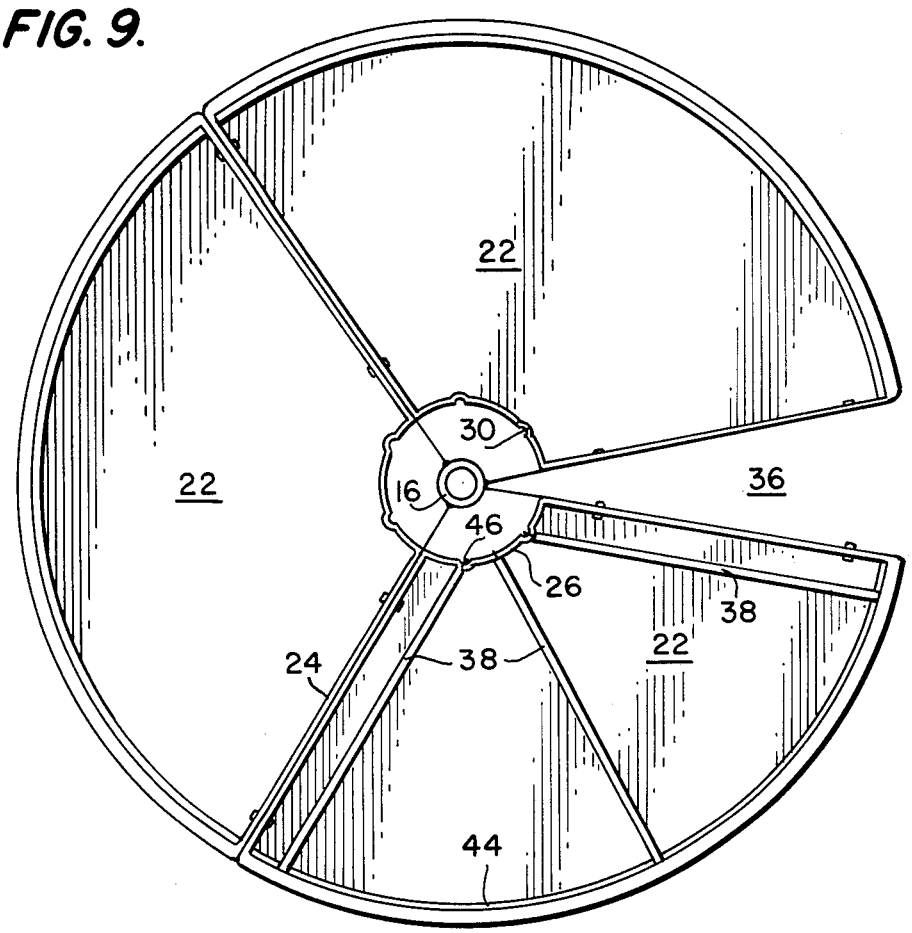
Figure 10:
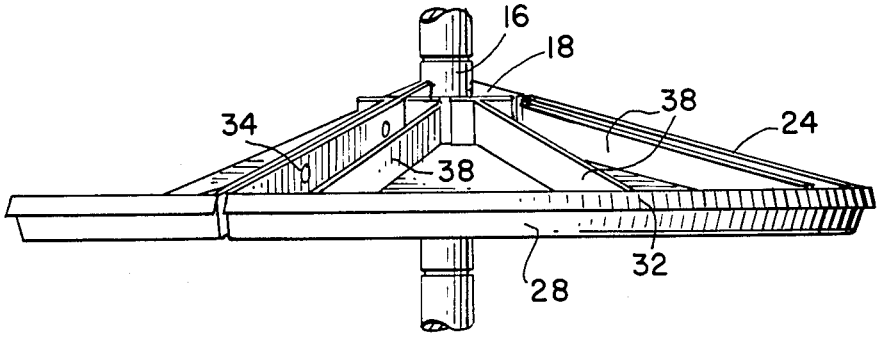
Figure 11:
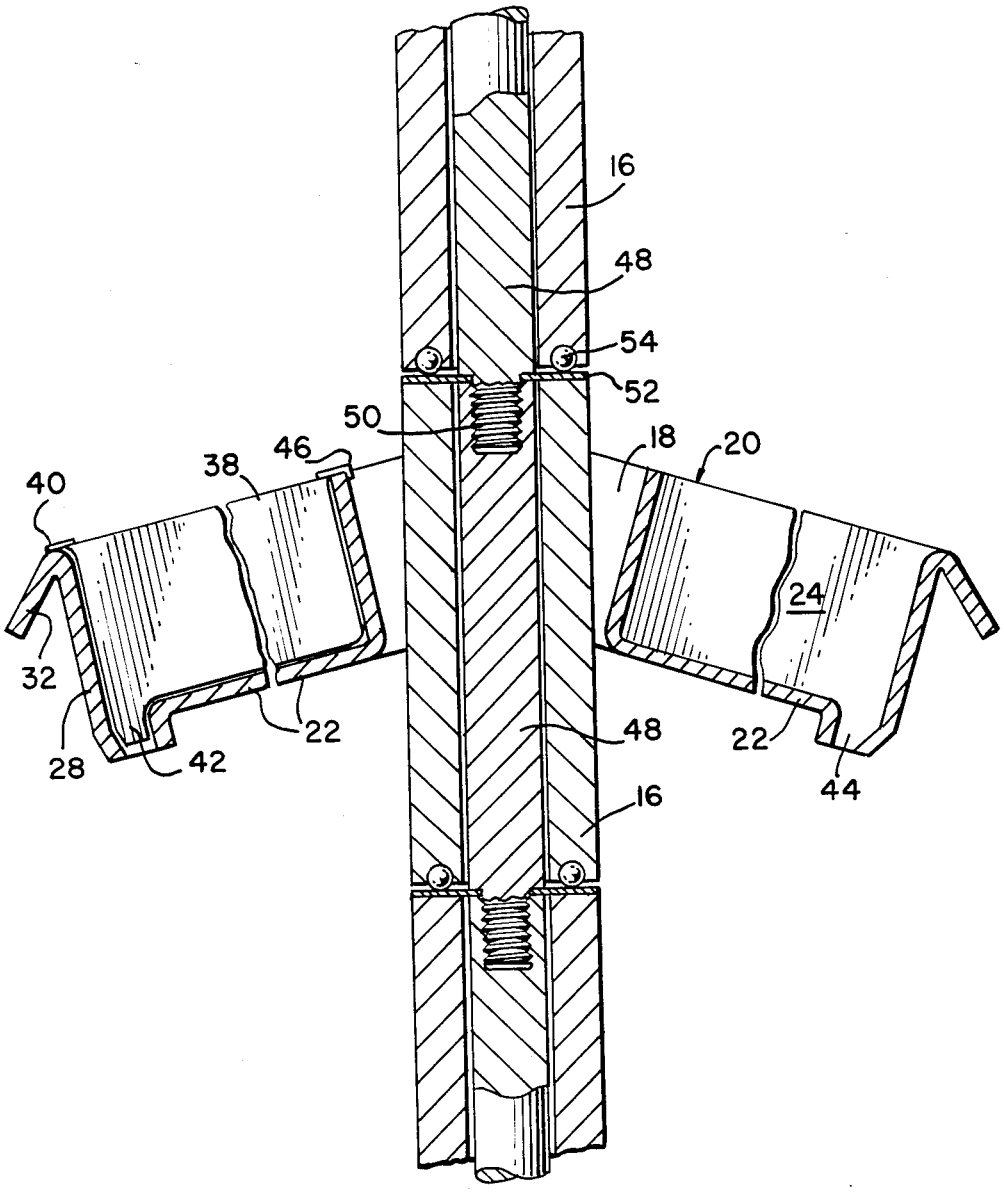

FIG. 1 is a side view of a tray stand in accordance with the invention,

FIG. 2 is a schematic illustration of a tray in the tray stand according to FIG. 1, seen from above, FIG. 3 is a schematic view similar to the one in FIG. 2, but to a larger scale and only illustrating the central portion of the tray, FIG. 4 is a schematic perspective view illustrating a tray section and its mounting on the holder for the tray in question, and FIG. 5 schematically illustrates a section through two adjacent tray sections, FIG. 6 is a side view of another embodiment of a tray stand in accordance with the invention, FIG. 7 is a plan view to a larger scale of a tray included in the tray stand of FIG. 6, FIG. 8 is a side view of the tray in FIG. 7, FIGS. 9 and 10 are a plan view and side view respectively of the tray in FIGS. 7 and 8, provided with loose partition walls, FIG. 11 is a section to an even larger scale through the vertical column of rotation shaft of the tray stand, on which a tray has been rotatably mounted.

As will be seen from the drawing, especially FIG. 1, a tray stand in accordance with the invention includes a central, vertical column 1, which is normally carried by a base, a foot or the like 2. The central column 1 carries a plurality of circular trays or shelves 3 arranged one above the other, and which are individually rotatable round the column 1.

As will most clearly be seen from FIGS. 2 and 3, each such circular tray comprises a plurality, in the illustrated embodiment six, substantially circle sector-shaped sections 4, which are carried by a common holder 5 rotatably mounted on the central column 1. Each of these circle sector-shaped tray sections 4 is individually withdrawable and retractable in a substantially radial direction relative the holder 5. In FIG. 2 there is shown one of the circle sector-shaped tray sections 4 in its withdrawn position, while the remainder are in their normal, entirely retracted positions. When a tray section 4 is in its withdrawn position, the space on this section is easily accessible for refilling new goods on this section or for taking goods from it.

As will be seen from FIGS. 2–4, the holder 5 rotatably mounted on the central column 1 and common to a given tray, comprises to advantage a central part **5*a* and a number of arms 5*b* corresponding to the number of tray sections 4, these arms projecting out substantially radially from the central part 5*a*. The arms 5*b* each carry one of the circle sector-shaped tray sections 4, to advantage in the way illustrated in FIG. 4, by each section 4 being provided with a sleeve-like part 6 which is telescopically placed over the associated arm 5*b* on the holder 5. In this way, each tray section 4 can be displaced in a substantially radial direction along the associated arm 5*b* on the holder 5 between a normal, entirely retracted position and a withdrawn position. To advantage, each tray section 4** is provided with a suitable, manually operable latching means, with the aid of which each tray section can be locked in its retracted or withdrawn position.

In order that the goods shall be easily accessible at the outer edge of the tray sections, without the sections needing to be withdrawn, the arms **5*b* of the rotatable holders 5 are to advantage arranged such that they are inclined downwards, e.g. at an angle of about 15° relative to the horizontal plane. The tray sections 4** will thus also slope in the same way, whereby the goods kept on the tray sections will glide down towards the outer arcuate edge of the tray sections at the rate the goods are removed therefrom.

As is most clearly apparent from FIGS. 4, each tray section 4 can to advantage be formed as a low box with a substantially circle sector-shaped bottom **4*a*, having along its arcuate outer edge an arcuate wall 4*b* and along its radial side edges walls 4*c* and 4*d*. The bottom 4*a* does not need to extend right into the inner tip of the tray section, which may lack a bottom, as illustrated in FIG. 4. This makes the tray section lighter and facilitates manufacture of the bottom 4*a*. Since the tray sections 4 slope downwards and outwards relative the horizontal plane it is advantageous that the bottom 4*a* in each tray section is conically curved, so that the tray sections carried by one and the same holder 5 and together forming a tray, extend along a conical surface with a vertex angle corresponding to the slope of the tray sections relative the horizontal plane. There is thus achieved that the spacing in height between two trays lying one above the other is everywhere just as great, which is advantageous with respect to the height of the goods placed on the tray sections. At its outer or forward edge, the tray section 4 can be provided with a handle 7, which is used for withdrawing and retracting the individual tray sections and also for rotating an entire tray round the column 1. Furthermore, each section 4 can be provided at its inner, narrower end with a wire 8, or some other suitable element preventing goods from falling down through the opening 9 where the tray sections have no bottom 4***a*. If so desired, the space on a tray section can be divided up into several compartments with the aid of suitably formed partition walls, not illustrated on the drawing, which are attached to the wire 8 and the front wall 4*b* of the tray sections.

By the arms 5*b* on the holder 5 being formed with a suitable cross section, e.g. rectangular as in the illustrated embodiment, and the telescope sleeves 6 on the tray sections 4 being formed with a corresponding cross section, it is achieved that the tray sections 4 will be non-rotatable about the arms 5*b*. Further improved stability may be achieved by the radial side walls 4*c*, 4*d* of the tray sections 4 being formed with elements engaging each other in the mutually adjacent tray sections in the same tray, when the tray sections are in a retracted position, and which prevent mutual movement between adjacent tray sections in a direction at right angles towards the plane of the tray section and which thereby achieves a mutual stabilization of associated tray sections. This can be achieved in a very simple and advantageous way by the radial side walls 4*c* and 4*d* of the tray sections 4 being formed with cross section configurations engaging with, and complemental to each other, as is schematically illustrated in FIG. 5, which is a section through the mutually adjacent side walls 4*c* and 4*d* of two mutually adjacent tray sections. These profiles can advantageously be provided with a cushioning material on their coacting surfaces.

The alternative embodiment of a tray stand according to the invention illustrated in FIG. 6 includes a foot 10, a vertical column 12 carried by the foot 10, the construction of the column being described in detail below, there being a plurality of trays 14 mounted on the column 12, such as to be mutually independently rotatable.

Each tray 14 is circular, and, as illustrated in FIGS. 7 and 8 in the illustrated embodiment, includes a hub 16, from which depart a plurality of arms of spokes 18, in this particular case four arms 18, which divide the circle into four sectors. Three of these circle sectors are equally as great and in these there are arranged circle sector-shaped tray sections 20 comprising a bottom surface 22 and side walls 24, as well as an inner 26 and an outer 28 peripheral wall, the inner wall being provided with substantially vertically extending depressions 30 serving as reinforcing, and possible fixings for loose partition walls, as described in detail below. The outer peripheral wall 28 is provided with a flange 32 for reinforcing its edge. The three tray sections 20 are arranged between the arms 18 and attached to them with suitable fastening means, such as screws or rivets 34. In accordance with the invention these three circle sector-shaped tray sections 20 form together a circle sector having an extension less than 360° of the circle, thus to form a fourth lesser sector 36 in which no tray section is arranged, this sector 36 forming an opening in the tray (see also FIG. 6). The opening 36 is given a size such that articles and objects in the case of use in question, which are to be stored in the trays, can be comfortably placed via the opening 36 at least on the underlying tray, also furthest in on it towards the inner wall 26.

By rotating the underlying and/or the overlying tray, the entire storage surface in the underlying tray will be accessible for refilling and possible removal of articles.

Of course, the number of arms 18 and thereby the number of tray sections 20, as well as the size of them, may be varied to meet requirements placed by the user of the tray stand. Another way of changing the division of the trays is shown in FIGS. 9 and 10, in which the parts of the trays which are the same as in FIGS. 7 and 8 have been given the same reference denotations. One or more of the tray sections 20 is here divided into different compartments with the aid of loose partition walls 38 in a desired manner, in the illustrated case two long, narrow rectangular compartments and two that are larger and circle sector-shaped. As is also apparent from FIG. 6, the partition walls 38 are upwardly formed with a tip 40, gripping over the outer peripheral wall 28 of the section 20, and downwards with a hook-shaped foot 42 engaging in a trough-like opening 44 extending downwards along the outer peripheral edge of each tray section 20. At the end of the partition wall 38 facing towards the centre of the circular tray 14 there is arranged a hook 46 gripping over the edge of the inner peripheral wall 26, preferably in one of the depressions 30 in the wall 26.

As previously mentioned, the trays 14 are mounted rotatably on a vertical column 12 extending along the entire height of the tray stand. As illustrated in FIG. 11, the column includes several sections 48 which are identically alike, and provided with a threaded stub 50 adapted for screwing into a mating thread in an unerlying section 48. A desired number of such sections 48 are screwed together in this way to form a tray stand of the desired height. The lowest section 48 in the column 12 is threaded into a mating thread in the foot 10 as illustrated in FIG. 6.

A washer 52 is clamped between the screwed-together sections 48 at each joint, to form a race for a number of balls 54 arranged in a groove in the lower face of each shelf hub 16. These balls form, together with the washer, a rolling bearing for facilitating rotation of the hub 16 round the stationary column 12. The length of each section 48 in the column 12 is somewhat greater than the length of the tubular tray hubs 16, to make room for the washer 52 and the necessary clearance between the hub 16 and washer 52. The length of each section 48 will thus also define the desired distance between the trays 14 in the assembled tray stand.

It will be apparent from the above description that in accordance with the invention there has been achieved a tray stand of very simple construction, with which the objects set forth in the introduction have been achieved. By arranging the tray sections 4 withdrawable, as shown in the embodiment of FIGS. 1 to 5, or forming an opening 36 such as the tray sections 22 in the embodiment of FIGS. 6–11, there is obtained the possibility of easily filling and possibly removing articles on an underlying tray. The tray stand can be very rapidly built up to the desired height, due to the embodiment as shown in FIG. 11.

It should be understood that the illustrated and described embodiments are only examples of the realization of the invention, and that alterations and modifications can be made within the scope of the following claims.

We claim:

1. A tray stand having a vertical column with a plurality of vertically spaced holders rotatably mounted thereon, each of said holders including a plurality of circumferentially spaced, radially extending arms, and a plurality of circular trays rotatably mounted one above the other and carried by the column, each tray comprising a plurality of substantially circle sector-shaped sections, each of said tray sections having a sleeve thereon which slidably receives an arm, wherein the tray sections of each tray are carried on a common holder together form the circular tray, the circle sector-shaped sections being arranged in the tray stand so that the whole surface of the section is accessible without obstruction by the overlying tray, the sleeves and associated tray sections being individually withdrawable and retractable in a substantially radial direction on corresponding arms.

2. Tray stand as claimed in claim 1, wherein the tray sections, forming the circular tray, form an opening in the tray, the opening having a size such that the articles or objects can be removed from, or placed on the tray, situated nearest below the opening.

3. Tray stand as claimed in claim 1, wherein the trays slope downwards in a direction from the column towards the outer periphery of the trays.

4. Tray stand as claimed in claim 3, wherein the tray sections have a conically curved shape corresponding to said slope.

5. Tray stand as claimed in claim 3, wherein each sleeve is thrust over the associated arm of the holder, the arm having a cross section which prevents rotation of the tray sections about the longitudinal axes of the arm.

6. Tray stand as claimed in claim 1, wherein the column comprises a plurality of shaft-like sections the sections being screwed one into the other, whereby the sections have a length defining the distance between two trays and have a bearing at the joint between two sections on which the holder of the tray rests.

7. Tray stand as claimed in claim 1, wherein the tray sections are box-shaped one or more of the walls of the box being provided with reinforcing means.

* * * * *